US006329618B1

(12) United States Patent
James et al.

(10) Patent No.: US 6,329,618 B1
(45) Date of Patent: Dec. 11, 2001

(54) REED SWITCH WITH SHOCK SENSING MASS WITHIN THE GLASS CAPSULE

(75) Inventors: Philip James, Knavesmire; Anthony Howell, Hoxne, both of (GB)

(73) Assignee: Breed Automotive Technology, Inc., Lakeland, FL (US)

( * ) Notice: Subject to any disclaimer, the term of this patent is extended or adjusted under 35 U.S.C. 154(b) by 0 days.

(21) Appl. No.: 09/860,888

(22) Filed: May 18, 2001

(51) Int. Cl.[7] ..... H01H 35/14

(52) U.S. Cl. ..... 200/61.45 M; 200/61.53; 335/151; 335/153; 335/154; 335/205

(58) Field of Search ..... 335/151–154, 335/205–208; 200/61.45 R, 61.53, 61.45 M

(56) References Cited

U.S. PATENT DOCUMENTS 3,644,854 * 2/1972 Steenmeijer ..... 335/153

5,212,357 5/1993 Reneau ..... 200/61.45

* cited by examiner

*Primary Examiner*—Ramon M. Barrera
(74) *Attorney, Agent, or Firm*—Lonnie R. Drayer; Patrick J. Stiennon

(57) ABSTRACT

A shock sensor has a shock sensing magnetic mass that rides on the inside of a glass tube that is sealed about a reed switch. The reed switch has a first stop positioned so that the shock sensing magnetic mass when resting against the first stop does not cause the reeds of the reed switch to attract. A spring extends between the shock sensing magnetic mass and a second stop. Acceleration causes the sensing mass to accelerate toward the second stop. The motion of the magnetic sensing mass causes the switch reeds to attract and close the reed switch. The entire shock sensing mechanism is hermetically sealed within the glass capsule of the reed switch. The reed switch within the glass capsule detects movement of the shock sensing mass.

11 Claims, 1 Drawing Sheet

48
22
32
36
28
40
26
30
46
38
24
44
34
42
21
20

REED SWITCH WITH SHOCK SENSING MASS WITHIN THE GLASS CAPSULE

FIELD OF THE INVENTION

The present invention relates to shock sensors in general and to shock sensors employing a reed switch in particular.

BACKGROUND OF THE INVENTION

Shock sensors are widely used in automobiles to detect the onset of a crash. Typically the magnitude and direction of the crash are sensed by micro-mechanical devices that are fabricated as part of an electronic chip. However, integrated circuit chips and micro-mechanical devices are subject to electromagnetic interference, with the result that sometimes a crash is indicated when no crash event is taking place. Macro scale mechanical shock sensors are employed as a safety device to provide a positive indication that the crash of a given magnitude is occurring. With the assurance that a crash is actually taking place the electronics associated with the micro-mechanical shock sensors can determine the magnitude and direction of the crash and deploy various safety systems in accordance with predetermined or adaptive logic.

Reed switches are often employed in the construction of mechanical shock sensors because of their extreme reliability, low-cost and relatively high current switching capabilities. Reed switches are also hermetically sealed from the atmosphere that contributes to their reliability and makes them suitable for use in hostile environments. Existing shock sensors often employ a second hermetic seal about a shock sensing mass and spring in order to form a shock sensor protected from the environment.

What is needed is a shock sensor which has the reliability of a reed switch and which provides an improvement in cost and packaging size.

SUMMARY OF THE INVENTION

The shock sensor of this invention employs a shock sensing magnetic mass that rides on the inside of the glass tube that is sealed about a reed switch. The reed switch is formed by two reeds, formed on the ends of electrical leads that pass through the sealed ends of the glass capsule. Each lead has a portion within the glass capsule that forms a stop. The stops are positioned between the leads and the reeds making up the reed switch. A first stop on a first lead supports a magnetic sensing mass. A second stop, on a second lead, is positioned opposed to and spaced from the first stop and supports a spring that biases the magnetic sensing mass against the first stop. The first stop is positioned so that the shock sensing magnetic mass when resting against the first stop does not cause the reeds of the reed switch to attract and close. Acceleration which is sufficiently aligned with the glass capsule forming the reed switch causes the sensing mass to accelerate toward the second stop, while the motion of the magnetic sensing mass causes the reed switch reeds to attract and close the reed switch. The entire shock sensing mechanism is hermetically sealed within the glass capsule of the reed switch. The reed switch within the glass capsule detects movement of the shock sensing mass, and provides a closed circuit that is used by the automobile safety system to determine that the shock sensor has detected a crash event.

It is a feature of the present invention to provide a shock sensor where the entire shock sensor mechanism is hermetically sealed.

It is another feature of the present invention to provide a shock sensor of reduced packaging size.

It is a yet further feature of the present invention to provide a shock sensor that can be mounted in the fashion identical to a reed switch with staple formed leads.

Further objects, features and advantages of the invention will be apparent from the following detailed description when taken in conjunction with the accompanying drawings.

DETAILED DESCRIPTION OF THE INVENTION

Figures 1, 2, 3:
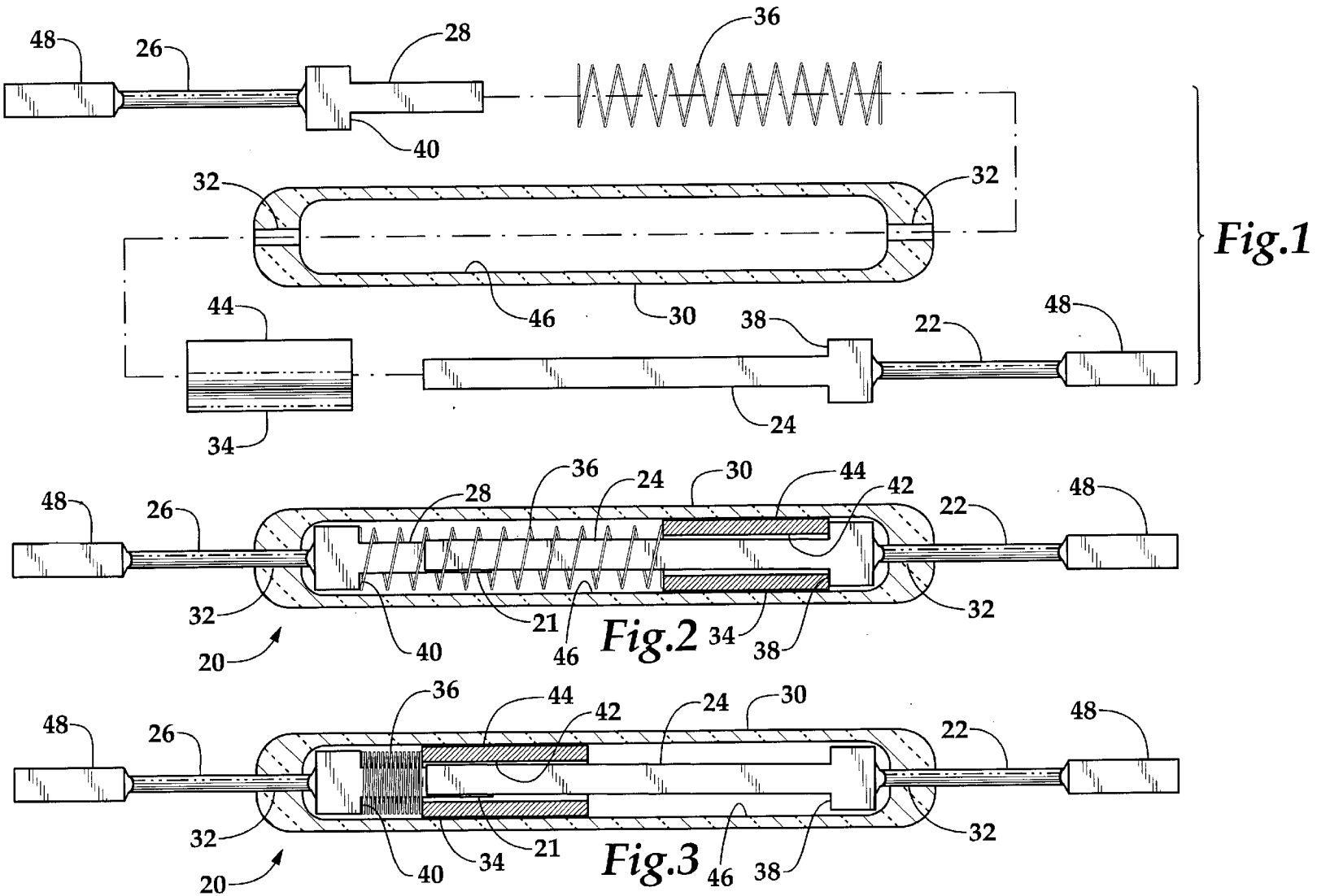
FIG. 1 is an exploded isometric view of the shock sensor of this invention.
FIG. 2 is a side elevation view of the shock sensor of FIG. 1 shown in the non-activated position.
FIG. 3 is a side elevation view of the shock sensor of FIG. 1 shown in the activated position.

Referring more particularly to FIGS. 1–3 wherein like numbers refer to similar parts, a shock sensor 20 is shown in FIGS. 2 and 3. The shock sensor 20 has all the components necessary to form a reed switch 21: a first ferromagnetic lead 22 with a first integrally formed flexible reed 24; and a second ferromagnetic lead 26 with a second integrally formed flexible reed 28, both the first and second ferromagnetic leads 22, 26 extending into a glass capsule 30. The leads 22, 26 are hermetically sealed to the glass capsule 30 where they pass through the wall 32 of the capsule 30. To avoid problems associated with hysterisis, the ferromagnetic leads 22 and the flexible reeds 24 are typically annealed to a dead soft condition.

A conventional shock sensor based on a reed switch has an external magnetic sensing mass which moves against a spring until the magnetic field generated by the sensing mass causes the reed switch to close. The shock sensor 20 incorporates a magnetic shock sensing mass 34 and spring 36 positioned inside the hermetically sealed glass capsule 30. As shown in FIG. 2, the magnetic shock sensing mass 34 is positioned against a first stop 38 which is integrally formed with the first lead 22. A spring 36 extends between the sensing mass 34 and a second stop 40 integrally formed with the second lead 26.

When mounting a shock sensing mass 34 internal to the glass capsule 30, the components making up the reed switch 21 must be designed to accommodate the new function. The shock-sensing magnet 34 has the shape of a cylinder with a central cylindrical opening 42 that is aligned with cylindrical magnet 34. The magnet because of its small size can be fabricated from Alnico, either cast or sintered, from rare earth alloys such as cerium-cobalt-copper, or other material with suitable properties. The magnetic sensing mass 34 is coated with a nylon that results in a low friction coating. The exterior surface 44 of the cylindrical shock sensing magnet 34 rides along the interior of the glass surface 46 which acts as a guide.

In a typical reed switch, the glass capsule is a relatively low tolerance part without critical dimensions. However because of the new function the glass capsule performs in the shock sensor 20, the interior surface must be specified so as to assure the uniform and reliable motion of the shock sensing mass 34 along the inside surface 46 of the glass capsule. In addition the glass capsule inside cylindrical surface 46 must be accurately aligned axially with the reeds 24, 28 making up the reed switch.

In a conventional reed switch both reeds are of the same length and size, or only a single reed is employed as in the Form AC@ single pole double throw type reed switch. However the shock sensor 20 must allow the magnet to be positioned sufficiently far from the second reed 28 so that the reed switch remains open. For this reason the second flexible reed 28 is shorter than the first flexible reed 24.

In all reed switches the leads and reeds are constructed of ferromagnetic material, typically iron-nickel, and the reeds and are aligned and overlap. The overlap or contact area is plated with a precious or semiprecious metal. The reeds act as magnetic flux conductors when exposed to an external magnetic field from a permanent magnet. Poles of the opposite polarity are created in opposed reeds and the contacts close when the magnetic force of attraction exceeds the spring rate of the reeds. As the external magnetic field is reduced, so that the force between the reeds is less than the elastic restoring force, the reeds or blades spring open.

In the shock sensor 20 the leads 22, 26 must incorporate stops 38, 40 to control the position of the shock sensing magnetic mass 34 and the positioning of the spring 36. The strength and size of the shock sensing magnet 34 must be great enough to induce poles of opposite plurality in the reeds 24, 28 and so close the reed switch 21. At the same time, the arrangement of parts must allow the magnet to be positioned in the non-activated position as shown in FIG. 2 so the magnet is sufficiently distant from the second reed switch so as not to cause the reed switch reeds to attract and close the reed switch 21. As shown in FIGS. 1–3 the first flexible reed 24 is more than twice as long as the second reed 28.

The shock sensor 20 may be mounted to a circuit board either by through board leads (not shown) or by surface mount lead ends 48 as shown in FIGS. 1B3. A circuit board is typically mounted within the vehicle at a position or on a structural member that is found by analysis or experimentation to provide a representative, shock environment indicative of when the vehicle is undergoing a crash event. Onboard microelectronic acceleration sensors in combination with safety system logic use the output from the shock sensor 20 to determine that the accelerations detected by the microelectronic acceleration sensors are not due to spurious signals induced by electromagnetic interference. The safety system logic then, in accordance with the preprogrammed logic, determines whether and how to deploy various safety devices such as air bags, and seat belt tensioners.

The manufacture of reed switches is a highly automated and precise process, by incorporating shock-sensing elements within the reed switch glass capsule many advantages are achieved.

It should be understood that the magnetic sensing mass could ride on the first flexible reed, and could further have portions of the magnet, which engage only the short sides of the rectangular shaped reed. It may also be possible to increase minimum dwell by shaping the magnet as disclosed in U.S. Pat. No. 5,212,357 to Reneau that is incorporated herein by reference.

It is understood that the invention is not limited to the particular construction and arrangement of parts herein illustrated and described, but embraces such modified forms thereof as come within the scope of the following claims.

We claim:

1. A shock sensor comprising:

a first ferromagnetic lead;

a second ferromagnetic lead;

a glass capsule hermetically sealed about the first ferromagnetic lead and the second ferromagnetic lead, the glass capsule defining an interior volume;

a first ferromagnetic reed positioned within the glass capsule and extending from the first lead, the first reed having a first electrical contact area;

a second ferromagnetic reed positioned within the glass capsule and extending from the second lead, the second reed having a second electrical contact area, the second electrical contact area positioned to overlie the first electrical contact area;

a magnetic mass, which forms a shock sensing mass, mounted within the interior volume of the glass capsule, wherein the magnetic mass is mounted for motion between a first position, where the magnetic field produced by the magnetic mass is insufficient to cause the first electrical contact area to be moved against the second contact area, and a second position, where the magnetic mass imposes sufficient magnetic field to cause the first electrical contact area to engage the second electrical contact area to produce a closed-circuit between the first lead and the second lead; and a biasing member, biasing the magnetic mass away from the second position.

2. The shock sensor of claim 1 wherein the magnetic mass is coated with a low friction coating, and wherein the glass capsule has an interior surface, and the magnetic mass is slidably engaged with said interior surface.

3. The shock sensor of claim 1 wherein the magnetic mass is substantially cylindrical, and has portions forming a central cylindrical opening through which the first reed passes.

4. The shock sensor of claim 1 wherein the first lead and the first reed are integrally formed, and a portion of the first lead forms a first stop, against which the magnetic mass is biased by a spring forming the biasing member, the stop thus defining the first position, and wherein the second lead and the second reed are integrally formed, and a portion of the second lead forms a second stop, the spring forming the biasing member extending between the second stop and the magnetic mass, to bias the magnet against the first stop in the first position.

5. The shock sensor of claim 4 wherein the first reed is substantially longer than the second reed.

6. A shock sensor comprising:

a first soft magnetic member having portions forming a first mounting lead, portions forming a first flexible reed, and portions forming a first stop;

a second soft magnetic member having portions forming a second mounting lead, portions forming a second reed, and portions forming a second stop, wherein the first soft magnetic member and the second soft magnetic member are mounted in opposite ends of a substantially cylindrical glass capsule, so that the first reed and second reed overlap in spaced relation, forming overlapping portions, and wherein the cylindrical glass capsule is hermetically sealed to the first mounting lead and the second mounting lead, the cylindrical glass capsule defining a hermetically sealed interior volume, the first flexible reed, the first stop, the second flexible reed and the second stop all being interior of the hermetically sealed interior volume formed by the glass capsule;

a magnetic mass mounted on the first soft magnetic member for motion between a first position abutting the first stop to a second position distal from the first stop, and sufficiently close to the overlapping portions to cause the first reed and the second reed to attract, to close an electrical circuit; and a spring extending between the second stop and the magnetic mass to bias the magnetic mass against the first stop, so that motion of the magnetic mass is opposed by the spring, wherein the spring and the magnetic mass are interior of the hermetically sealed interior volume formed by the glass capsule.

7. The shock sensor of claim 6 wherein the magnetic mass is coated with low friction coating, and wherein the glass capsule has an interior surface, and the magnetic mass is slidably engaged with said interior surface.

8. The shock sensor of claim 7 wherein the first reed is substantially longer than the second reed.

9. The shock sensor of claim 7 wherein the magnetic mass is substantially cylindrical, and has portions forming a central cylindrical opening through which the first magnetic reed passes.

10. A shock sensor comprising:

a glass capsule having a first end and a second end, the glass capsule having portions defining an interior volume;

a first ferromagnetic lead extending into the first end of the glass capsule, and hermetically sealed thereto;

a second ferromagnetic lead extending into the second end of the glass capsule, and hermetically sealed thereto;

a first ferromagnetic reed in electrical contact with the first lead and extending within the glass capsule interior volume towards the second end of the glass capsule, portions of the first reed defining an upwardly facing first electrical contact area;

a second ferromagnetic reed in electrical contact with the second lead and extending within the glass capsule interior volume towards the first end of the glass capsule, portions of the second reed defining a downwardly facing second electrical contact area positioned in spaced relation to the first electrical contact area of the first magnetic reed;

a magnet positioned within the glass capsule interior volume, the magnet having a central opening through which the first reed extends;

a first stop adjacent the glass capsule first end;

a second stop adjacent the glass capsule second end; and a biasing member positioned within the glass capsule interior volume which urges the magnet against the first stop, such that under acceleration the magnet is driven against the biasing member toward the second stop to cause the first electrical contact area to close on the second electrical contact area.

11. The shock sensor of claim 10 wherein the length of the first lead is greater than twice the length of the second lead.

* * * * *